US009424781B2

(12) United States Patent
Park

(10) Patent No.: US 9,424,781 B2
(45) Date of Patent: Aug. 23, 2016

(54) ORGANIC LIGHT EMITTING DISPLAY DEVICE

(71) Applicant: LG Display Co., Ltd., Seoul (KR)

(72) Inventor: Jiwoong Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 27 days.

(21) Appl. No.: 14/581,618

(22) Filed: Dec. 23, 2014

(65) Prior Publication Data

US 2016/0071464 A1 Mar. 10, 2016

(30) Foreign Application Priority Data

Sep. 10, 2014 (KR) ..... 10-2014-0119609

(51) Int. Cl.
*G09G 3/32* (2016.01)

(52) U.S. Cl.
CPC ..... *G09G 3/3291* (2013.01); *G09G 2300/0814* (2013.01); *G09G 2320/0233* (2013.01); *G09G 2320/043* (2013.01); *G09G 2330/023* (2013.01); *G09G 2330/028* (2013.01)

(58) Field of Classification Search
CPC ..... G09G 3/3291; G09G 2330/023; G09G 2320/043; G09G 2300/0814; G09G 2320/0233; G09G 2330/028
USPC ..... 345/76–83, 211–213, 690; 315/169.1–169.3
See application file for complete search history.

(56) References Cited

U.S. PATENT DOCUMENTS

2014/0240305 A1* 8/2014 Chae ..... G09G 3/3225 345/212
2015/0356919 A1* 12/2015 Wang ..... G09G 3/3241 345/690

* cited by examiner

*Primary Examiner* — Jennifer Nguyen
(74) *Attorney, Agent, or Firm* — Fenwick & West LLP

(57) ABSTRACT

An organic light emitting display is disclosed. The organic light emitting display includes a display panel having subpixels; a data driving part for supplying a data signal to the display panel; a compensation circuit part for sensing the subpixels; a power generation part for generating and outputting power to be supplied to the display panel and the data driving part; a voltage line wired between an output terminal of the power generation part and the display panel, the voltage line to transmit a voltage output from the power generation part to the display panel; and a power control part for controlling the voltage line.

6 Claims, 8 Drawing Sheets

ORGANIC LIGHT EMITTING DISPLAY DEVICE

CROSS-REFERENCE TO RELATED APPLICATION

This application claims the benefit of Korean Patent Application No. 10-2014-0119609 filed on Sep. 10, 2014, which is incorporated herein by reference for all purposes as if fully set forth herein.

BACKGROUND

1. Field

This present disclosure relates to an organic light emitting display device.

2. Description of the Related Art

With the development of information technology, the markets of display devices as connection media between a user and information are growing. Due to this reason, usage of display devices, such as an organic light emitting display (OLED), a liquid crystal display (LCD), and a plasma display panel (PDP), has increased.

Of the above-described display devices, the organic light emitting display device includes a display panel having a plurality of subpixels and a driving part driving the display panel. The driving part includes a scan driving part for supplying a scan signal to the display panel, and a data driving part for supplying a data signal to the display panel.

In the organic light emitting display device, when a scan signal, a data signal, and the like are supplied to a plurality of subpixels arranged in a matrix type, the selected subpixels emit light to display images.

Since characteristics (threshold voltage, current mobility, etc) of the device included in the subpixel vary during the use of the organic light emitting display device, the organic light emitting display device has various problems, such as a decrease in lifespan or brightness of a device according to the driving time.

SUMMARY

An aspect of the present invention is to provide an organic light emitting display including a display panel, a data driving part, a compensation circuit part, a power generation part, a voltage line, and a power control part. The display panel has subpixels. The data driving part supplies a data signal to the display panel. The compensation circuit part senses the subpixels. The power generation part generates and outputs power to be supplied to the display panel and the data driving part. The voltage line is wired between an output terminal of the power generation part and the display panel, and transmits a voltage output from the power generation part to the display panel. The power control part controls the voltage line.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention. In the drawings.

DETAILED DESCRIPTION OF PREFERRED EMBODIMENTS

Reference will now be made in detail to embodiments of the invention, examples of which are illustrated in the accompanying drawings.

Hereinafter, specific embodiments of the present invention will be described with reference to the accompanying drawings.

Figure 1:
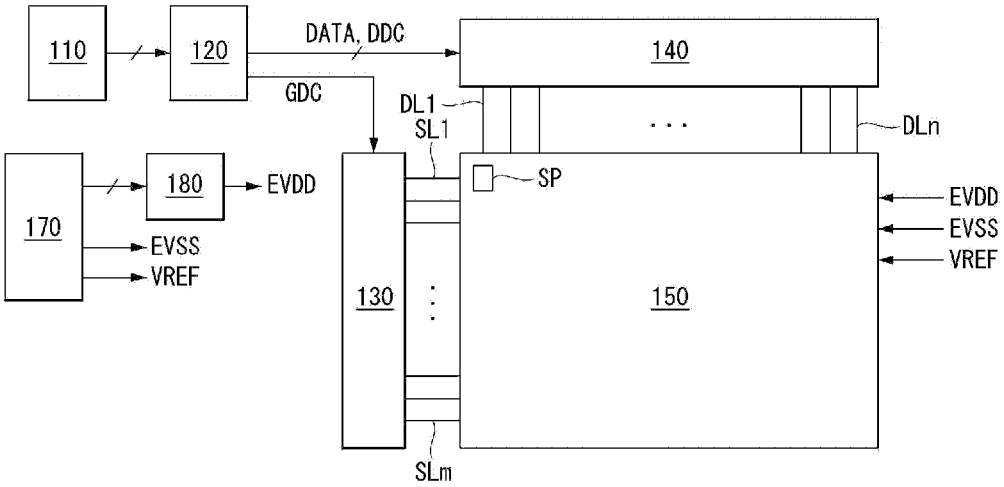
FIG. 1 is a diagram showing an organic light emitting display device according to an embodiment of the present invention.
Figure 2:
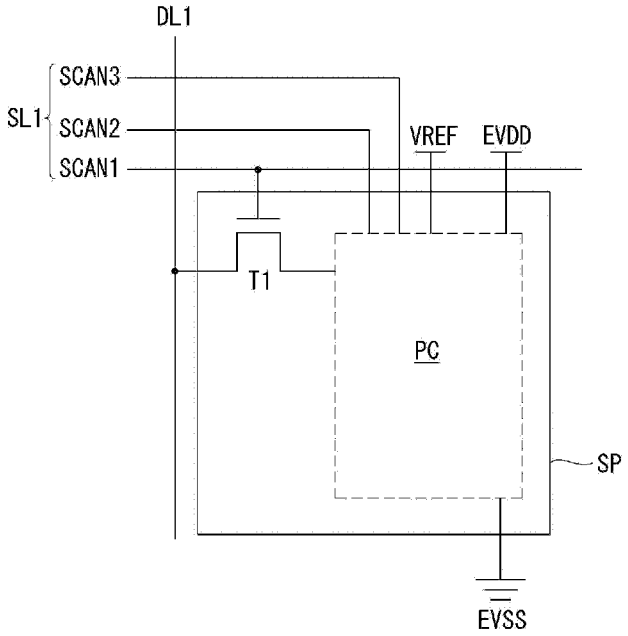
FIG. 2 is a schematic exemplary view of a structure of a subpixel.
Figure 3:
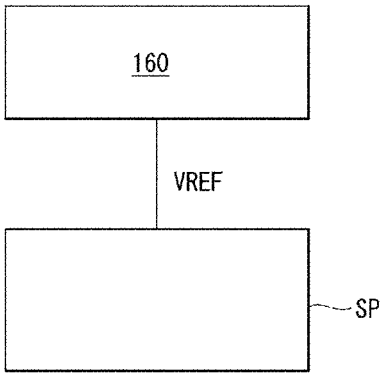
FIG. 3 is a schematic exemplary view of a structure of a compensation circuit part.

FIG. 1 is a diagram showing an organic light emitting display device according to an embodiment of the present invention; and FIG. 2 is a schematic exemplary view of a structure of a subpixel; and FIG. 3 is a schematic exemplary view of a structure of a compensation circuit part.

As shown in FIG. 1, an organic light emitting display device according to an embodiment of the present invention includes an image processing part 110, a timing control part 120, a scan driving part 130, a data driving part 140, a power generation part 170, a power control part 180, and a display panel 150.

The image processing part 110 generates control signals including a vertical synchronization signal, a horizontal synchronization signal, a data enable signal, a clock signal, and the like. The image processing part 110 stores the data signal, which is supplied from the outside, in an internal or external memory by the frame unit, and performs image processing on the stored data signal, and outputs image-processed data.

The timing control part 120 outputs the data signal in response to the control signals including the vertical synchronization signal, the horizontal synchronization signal, the data enable signal, and the clock signal, which are supplied from the image processing part 110. The timing control part 120 controls the operation timings of the scan driving part 130 and the data driving part 140 by using the timing control signal.

Since the timing control part 120 can determine a frame period by counting a number of data enable signals during 1 horizontal period, the vertical synchronization signal and the horizontal synchronization signal supplied from the image processing part 110 can be omitted. The timing control part 120 generates a gate timing control signal GDC for controlling the operation timing of the scan driving part 130, and a data timing control signal DDC for controlling the operation timing of the data driving part 140.

The scan driving part 130 sequentially generates scan signals while shifting the level of a gate driving voltage, in response to the gate timing control signal GDC supplied from the timing control part 120.

The scan driving part 130 supplies the scan signals through scan lines SL1 through SLm connected to subpixels SP included in the display panel 150. The scan driving part 130 may be formed in an integration circuit (IC) type and mounted on an external board, or may be formed in a bezel area of the display panel in a gate in panel (GIP) type through a thin film process.

The data driving part 140 samples and latches the data signal DATA supplied from the timing control part 120, in response to the data timing control signal DDC supplied from the timing control part 120, and converts the data signal DATA into parallel format data. The data driving part 140 converts the data signal DATA in a digital signal to an analog signal in response to a gamma reference voltage.

The data driving part 140 supplies the data signal DATA through data lines DL1 through DLn connected to the subpixels SP included in the display panel 150. The data driving part 140 is formed in an integration circuit (IC) type and then mounted on an external substrate, or mounted on the bezel area of the display panel 150.

The display panel 150 includes the subpixels SP arranged in a matrix type. The subpixels SP emit light in response to a first voltage (high voltage) and a second voltage (low voltage) respectively supplied from a first voltage line EVDD and a second voltage line EVSS as well as the scan signals and the data signals respectively supplied from the scan driving part 130 and the data driving part 140.

The subpixels SP of the display panel 150 include a red subpixel, a green subpixel, and a blue subpixel, or, in some case, may include a white subpixel. When the white subpixel is included, light emission layers of the subpixels SP of the display panel 150 emit white light instead of emitting red, green, and blue lights. In this case, the emitted white light is converted into a red, green, or blue light through color conversion filters (e.g., RGB color filters). The white subpixel can emit the white light without color conversion filters.

The power generation part 170 generates the first voltage and the second voltage, and outputs the first voltage and the second voltage through the first voltage line EVDD and the second voltage line EVSS. The power generation part 170 can generate driving voltages for driving the timing control part 120, the scan driving part 130, and the data driving part 140.

The power control part 180 is positioned between the power generation part 170 and the first voltage line EVDD, and controls the transmission path of the first voltage, which is output from the power generation part 170. Specifically, the power control part 180 serves to control the transmission path of the first voltage such that the first voltage is transmitted through the first voltage line EVDD or blocked.

As shown in FIG. 2, the subpixel SP is connected to the data line DL1, the scan lines SCAN through SCAN3, a reference voltage line VREF, a first voltage line EVDD, and a second voltage line EVSS.

The subpixel SP includes a first transistor T1 and a pixel circuit PC. The pixel circuit PC includes a storage capacitor, a driving transistor, a compensation transistor, and an organic light emitting diode.

Except the data line DL1, the reference voltage line VREF, the first voltage line EVDD, and the second voltage line EVSS, the scan lines SCAN1 through SCAN3 include three lines. The reason the scan lines SCAN1 through SCAN3 include three lines is that the pixel circuit PC of the subpixel SP includes a compensation transistor.

Since characteristics (threshold voltage, current mobility, etc) of the device included in the subpixel vary during the use of the organic light emitting display device, the organic light emitting display device may have various problems, such as a decrease in lifespan or brightness of a device according to the driving time. To overcome this limitation, a compensation circuit part 160 as shown in FIG. 3 is used to compensate for the deterioration of the device.

As shown in FIG. 3, the compensation circuit part 160 senses the subpixel SP by using the reference voltage line VREF, and generates compensation data or the like based on the sensing values. For the compensation using the compensation data, there is (1) a method of varying the data signal based on compensation data; (2) a method of varying the gamma voltage based on compensation data; (3) a method of varying the first voltage based on compensation data; or a combination of methods (1) to (3) depending on the condition of the display panel or environmental conditions.

The compensation circuit part 160 may sense the impedance value of the organic light emitting diode and the threshold voltage value of the driving transistor of the subpixel SP and then perform a compensation operation based on the sensing result. However, hereinafter, the case in which the compensation circuit part 160 senses the impedance value of the organic light emitting diode included in the subpixel SP by using the reference voltage line VREF, and then performs the compensation operation based on the sensing result will be described as one example. The sensing of the impedance value of the organic light emitting diode by the compensation circuit part 160 may be conducted in various manners.

As a first example, the compensation circuit part 160 may sense the threshold voltages of organic light emitting diodes included in the subpixels by scan lines of the display panel 150 (designated by a line sensing manner). The line sensing manner is defined as sensing the impedance values of the organic light emitting diodes included in one line of subpixels.

As a second example, the compensation circuit part 160 may arrange the scan lines of the display panel 150 into groups and sense the threshold voltages of the organic light emitting diodes included in the subpixels by groups (defined as a group sensing manner). The group sensing manner is defined as sensing the impedance values of the organic light emitting diodes included in the subpixels on the N (N is an integer of 2 or greater) lines.

As a third example, the compensation circuit part 160 may sense the threshold voltages of the organic light emitting diodes included in the subpixels of the display panel 150 by frames (defined as a frame sensing manner). The frame sensing manner is defined as sensing the impedance values of the organic light emitting diodes included in all subpixels of the display panel 150.

As a fourth example, the compensation circuit part 160 may sense the impedance values of the organic light emitting diodes included in the subpixels while the line sensing manner, the group sensing manner, and the frame sensing manner are randomly selected depending on various states, conditions, or situations of the display panel 150 (defined as a random sensing manner).

The organic light emitting display device may be manufactured in a modular form based on the above-described configuration, and this will be described as follows.

Figure 4:
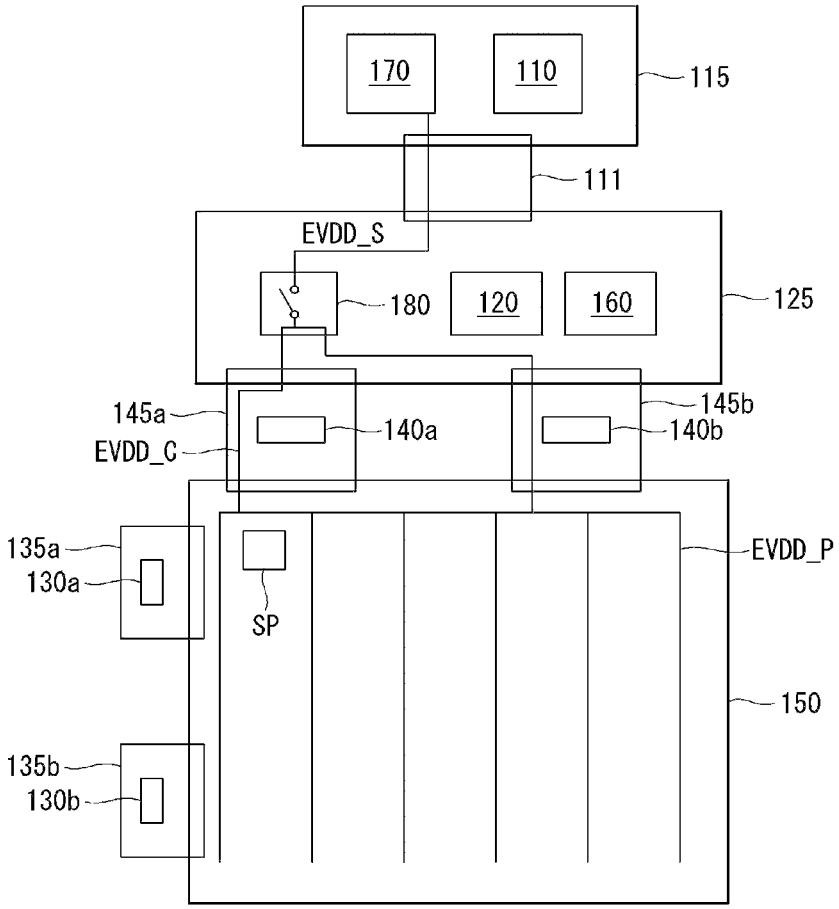
FIG. 4 is an exemplary view for showing modules of an organic light emitting display device according to a first embodiment of the present invention.
Figure 5:
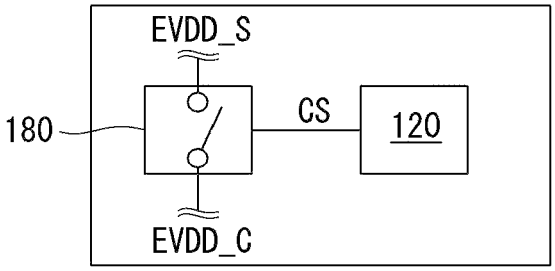
FIG. 5 is a diagram showing a power control part and a timing control part of FIG. 4.

FIG. 4 is an exemplary view for showing the modules of an organic light emitting display device according to a first embodiment of the present invention; and FIG. 5 is a diagram showing a power control part and a timing control part of FIG. 4.

As shown in FIG. 4, an organic light emitting display device according to a first embodiment of the present invention is manufactured in a modular form, including a system board 115, a timing circuit board 125, a cable 111, driving circuit boards 135*a*, 135*b*, 145*a*, and 145*b*, and a display panel 150.

The system board 115 includes an image processing part 110 and a power generation part 170. The image processing part 110 and the power generation part 170 are mounted on the system board 115 in an integrated circuit (IC) type. The system board 115 may be implemented as a printed circuit board (PCB) or a flexible printed circuit board (FPCB), but is not limited thereto.

The cable 111 electrically connects the system board 115 to the timing circuit board 125. The cable 111 may be implemented as a flexible flat cable (FFC), but is not limited thereto.

The timing circuit board 125 includes a timing control part 120, a compensation circuit part 160, and a power control part 180. The timing control part 120 and the compensation circuit part 160 are mounted on the timing circuit board 125 in an integrated circuit (IC) type. The power control part 180 is mounted on the timing circuit board 125 in an integration circuit (IC) type or an active device type. The timing circuit board 125 may be implemented as a printed circuit board (PCB) or a flexible printed circuit board (FPCB), but is not limited thereto. Meanwhile, the power generation part 170 may be formed on the timing circuit board 125 rather than on the system board 115.

The driving circuit boards 135*a*, 135*b*, 145*a*, and 145*b* include scan driving parts 130*a* and 130*b* and data driving parts 140*a* and 140*b*. The scan driving parts 130*a* and 130*b* and data driving parts 140*a* and 140*b* in an integration circuit (IC) type are mounted on the driving circuit boards 135*a*, 135*b*, 145*a*, and 145*b*. The driving circuit boards 135*a*, 135*b*, 145*a*, and 145*b* may be implemented as a printed circuit board (PCB) or a flexible printed circuit board (FPCB), but are not limited thereto.

The driving circuit boards 135*a*, 135*b*, 145*a*, and 145*b* are classified into first driving circuit boards 135*a* and 135*b* on which the scan driving parts 130*a* and 130*b* are mounted, and second driving circuit boards 145*a* and 145*b* on which the data driving parts 140*a* and 140*b* are mounted.

A case in which the first driving circuit boards 135*a* and 135*b* are connected to the left side of the display panel 150 and the second driving circuit boards 145*a* and 145*b* are connected to the top side of the display panel 150 is provided as one example. However, this is provided as merely an example of the present invention, and thus the present invention may vary depending on the resolution and size of the display panel 150. In addition, when the scan driving parts 130*a* and 130*b* are formed in a bezel area of the display panel 150 in a gate in panel (GIP) type, the first driving circuit boards 135*a* and 135*b* are omitted.

Meanwhile, a (1-1)th voltage line EVDD_S is formed on the system board 115, the cable 111, and the timing circuit board 125. The (1-1)th voltage line EVDD_S is a line for transmitting the first voltage output from the power generation part 170 to one end of the power control part 180. The (1-1)th voltage line EVDD_S is wired between the output terminal of the power generation part 170 and one end of the power control part 180.

A (1-2)th voltage line EVDD_C is formed on the timing circuit board 125 and the driving circuit boards 135*a*, 135*b*, 145*a*, and 145*b*. The (1-2)th voltage line EVDD_C transmits the first voltage, which is transmitted from the other end of the power control part 180, to a (1-3)th voltage line EVDD_P. The (1-2)th voltage line EVDD_C is wired between the other end of the power control part 180 and the display panel 150.

The (1-3)th voltage line EVDD_P is formed on the display panel 150. The (1-3)th voltage line EVDD_P transmits the first voltage, which is transmitted from the (1-2)th voltage line EVDD_C, to the subpixel SP of the display panel 150. The (1-3)th voltage line is formed on the display panel 150. The (1-3)th voltage line EVDD_P may be wired in a stripe type or a mesh type on the display panel 150. However, this is merely one example, and thus, the (1-3) the voltage lines EVDD_P may be wired in various forms in order to prevent the voltage drop (e.g., IR drop).

The power control part 180 controls the first voltage line EVDD. The power control part 180 serves to block the path such that the first voltage is not supplied to the display panel 150.

As shown in FIG. 5, a power control line is formed between the power control part 180 and the timing control part 120. The power control part 180 is turned on or turned off in response to the power control signal CS supplied through the power control line.

In the case where the power control part 180 is turned off, the first voltage is not supplied to the display panel 150. On the other hand, in the case where the power control part 180 is turned on, the first voltage is supplied to the display panel 150.

The timing control part 120 may generate a signal for controlling the compensation circuit part, the scan signal, or the like. Thus, the control of the power control part 180 under the control of the timing control part 120 is also advantageous in view of setting the driving timing.

In the above description, the case where the states of the line (connection or block) of the (1-1)th voltage line EVDD_S and the (1-2)th voltage line EVDD_C vary depending on the operation state of the power control part 180 is provided as one example. However, this case is merely one example, and thus the power control part 180 may control the state of the line between the (1-2)th voltage line EVDD_C and the (1-3)th voltage line EVDD_P.

Hereinafter, an example of the circuit structure of the subpixel and the driving waveform of the subpixel will be described.

Figure 6:
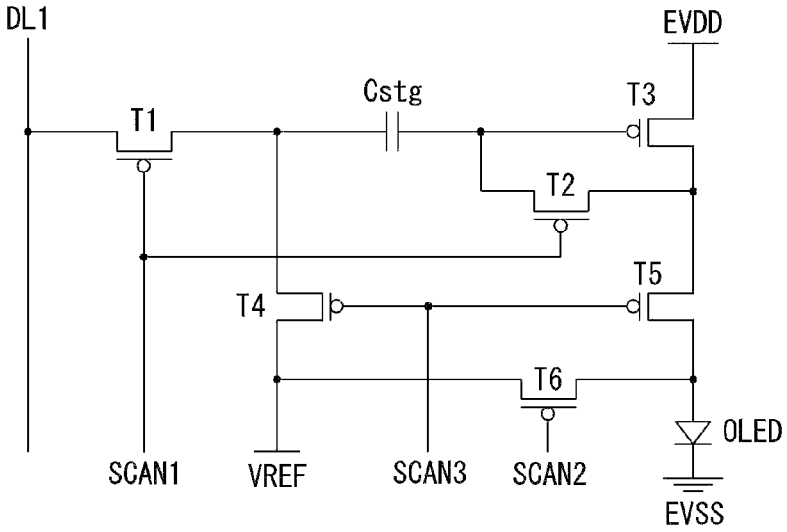
FIG. 6 is an exemplary view of a circuit of a subpixel.
Figure 7:
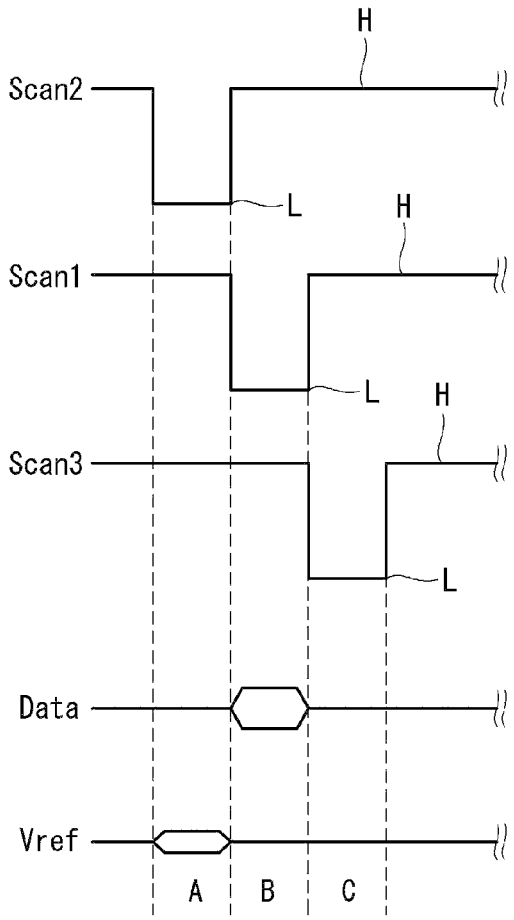
FIG. 7 is an exemplary view showing driving waveforms of the subpixel of FIG. 6.

FIG. 6 is an exemplary view of a circuit of a subpixel; and FIG. 7 is an exemplary view showing driving waveforms of the subpixel shown in FIG. 6.

As shown in FIG. 6, the subpixel includes a first transistor T1, a second transistor T2, a third transistor T3, a fourth transistor T4, a fifth transistor T5, a sixth transistor T6, a storage capacitor Cstg, and an organic light emitting diode OLED.

The second transistor T2, the fourth transistor T4, the fifth transistor T5, and the sixth transistor T6, except the first transistor T1, the third transistor T3, the storage capacitor Cstg, and the organic light emitting diode OLED, correspond to compensation transistors.

As for the first transistor T1, a gate electrode is connected to a first scan line SCAN1, a first electrode is connected to a data line DL1, and a second electrode is connected to one end of the storage capacitor Cstg. The first transistor T1 serves to transmit the data signal, which is supplied through the data line DL1, to the storage capacitor Cstg, in response to the first scan signal supplied through the first scan line SCAN1.

As for the second transistor T2, a gate electrode is connected to the first scan line SCAN1, a first electrode is connected to the other end of the storage capacitor Cstg and a gate electrode of the third transistor T3, and a second electrode is connected to a second electrode of the third transistor T3. The second transistor T2 serves to connect the gate electrode and the second electrode of the third transistor T3 in a diode connection state in response to the first scan signal supplied through the first scan line SCAN1.

As for the third transistor T3, a gate electrode is connected to the other end of the storage capacitor Cstg and the first electrode of the second transistor T2, a first electrode is connected to the first voltage line EVDD, and a second electrode is connected to a first electrode of the fifth transistor T5. The third transistor T3 serves to generate a driving current in response to the data voltage stored in the storage capacitor Cstg. The third transistor T3 is defined as a driving transistor.

As for a fourth transistor T4, a gate electrode is connected to the third scan line SCAN3, a first electrode is connected to the reference voltage line VREF, and a second electrode is connected to the second electrode of the first transistor T1 and one end of the storage capacitor Cstg. The fourth transistor T4 serves to initialize one end of the storage capacitor Cstg in response to a third scan signal supplied through the third scan line SCAN3. When one end of the storage capacitor Cstg is initialized, an initialization voltage (e.g., a second voltage or a negative voltage lower than the second voltage) may be supplied to the reference voltage line VREF, but is not limited thereto, and thus a discharging path may be formed.

As for a fifth transistor T5, a gate electrode is connected to the third scan line SCAN3, a first electrode is connected to the second electrode of the third transistor T3, and a second electrode is connected to an anode electrode of the organic light emitting diode OLED. The fifth transistor T5 serves to transmit the driving current, which is generated by the third transistor T3, to the organic light emitting diode OLED, in response to the third scan signal supplied through the third scan line SCANS. The fifth transistor T5 is defined as a light emission control transistor.

As for a sixth transistor T6, a gate electrode is connected to the second scan line SCAN2, a first electrode is connected to the reference voltage line VREF, and a second electrode is connected to the anode electrode of the organic light emitting diode OLED. The sixth transistor T6 serves to form a sensing path such that the impedance value of the organic light emitting diode OLED is sensed in response to the second scan signal supplied through the second scan line SCAN2.

As for the storage capacitor Cstg, one end is connected to the second electrode of the first transistor T1 and the second electrode of the fourth transistor T4, and the other end is connected to the first electrode of the second transistor T2 and the gate electrode of the third transistor T3. The storage capacitor Cstg serves to drive the third transistor T3 based on the data voltage stored therein.

As for the organic light emitting diode OLED, the anode electrode is connected to the second electrode of the fifth transistor T5 and the second electrode of the sixth transistor T6, and a cathode electrode is connected to the second voltage line EVSS. The organic light emitting diode OLED serves to emit light in response to the driving current supplied from the fifth transistor T5. The organic light emitting diode OLED can selectively emit various color lights, such as a red light, a green light, a blue light, and a white light, depending on a material of the organic light emission layer formed between the anode electrode and the cathode electrode.

As shown in FIG. 7, the above-described subpixel may be operated in a first section (A: an impedance value sensing period of the organic light emitting diode), a second section (B: a data signal writing section), and a third period (C: a light emission period of the organic light emitting diode) in that order. However, this is merely an example, and thus, the above-described subpixel may be operated in the second section (B), the third section (C), and the first section (A) in that order.

During the first section (A), the first and third scan signals Scan1 and Scan3 are set at a logic high H, and the second scan signal Scan2 is set at a logic low L. The sixth transistor T6 is turned on in response to the scan signal Scan2 of a logic low L. When the sixth transistor T6 is turned on, a reference voltage Vref is supplied to the reference voltage line VREF.

The reference voltage Vref is supplied to the anode electrode of the organic light emitting diode OLED. The reference voltage Vref supplied to the anode electrode of the organic light emitting diode OLED is discharged through the second voltage line EVSS. Here, the compensation circuit part senses the impedance value of the organic light emitting diode OLED through the turned-on sixth transistor T6.

During the second section (B), the third scan signal Scan3 is set at a logic high H as before, the second scan signal Scan2 is set at a logic high H, and the first scan signal Scan1 is set at a logic low L.

The first transistor T1 is turned on in response to the first scan signal Scan1 of a logic low L. When the first transistor T1 is turned on, the data signal is supplied to the data line DL1.

The data signal is supplied to the storage capacitor Cstg. The data signal supplied to the storage capacitor Cstg is stored as a data voltage. The third transistor T3 generates a driving current in response to the data voltage stored in the storage capacitor Cstg.

During the third section (C), the second scan signal Scan2 is set at a logic high H as before, the first scan signal Scan1 is set at a logic high H, and the third scan signal Scan3 is set at a logic low L.

The fourth and fifth transistors T4 and T5 are turned on in response to the third scan signal Scan3 of a logic low L. The driving current generated from the third transistor T3 by the turned-on fifth transistor T5 is supplied to the organic light emitting diode OLED. The organic light emitting diode OLED emits light in response to the driving current. The organic light emitting diode OLED emits a red light, a blue light, a green light, or a white light, depending on the organic light emission material formed between the anode electrode and the cathode electrode of the organic light emitting diode OLED.

Meanwhile, the initialization voltage may be supplied to the storage capacitor Cstg through the turned-on fourth transistor T4. Here, the initialization voltage is supplied through the reference voltage line connected to the compensation circuit part. The initialization voltage is set at a voltage at which the parasitic capacitance remaining in the storage capacitor Cstg can be removed.

Hereinafter, the present invention will be described in detail with reference to an example compared with a comparative example.

Figure 8:
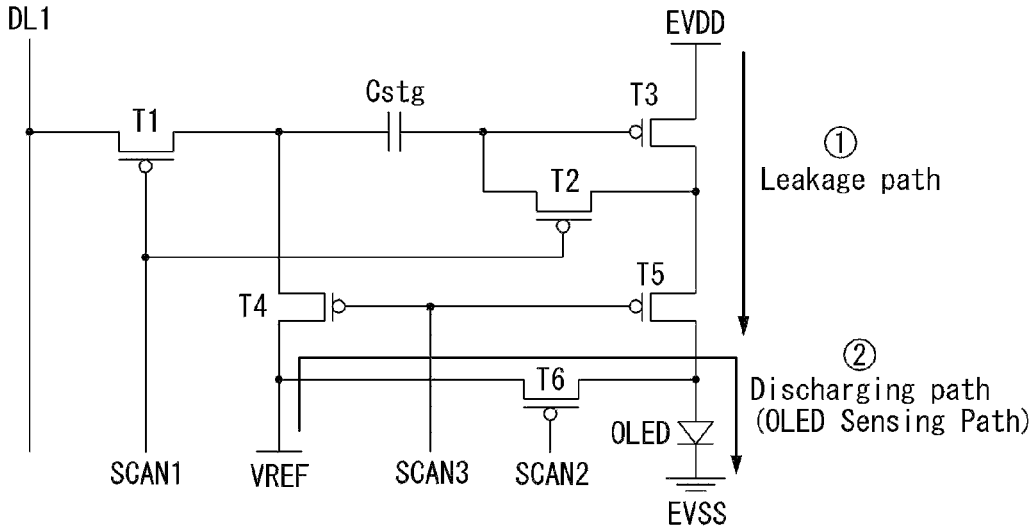
FIG. 8 is a view for illustrating unintended leakage current in the subpixel of FIG. 6.
Figure 9:
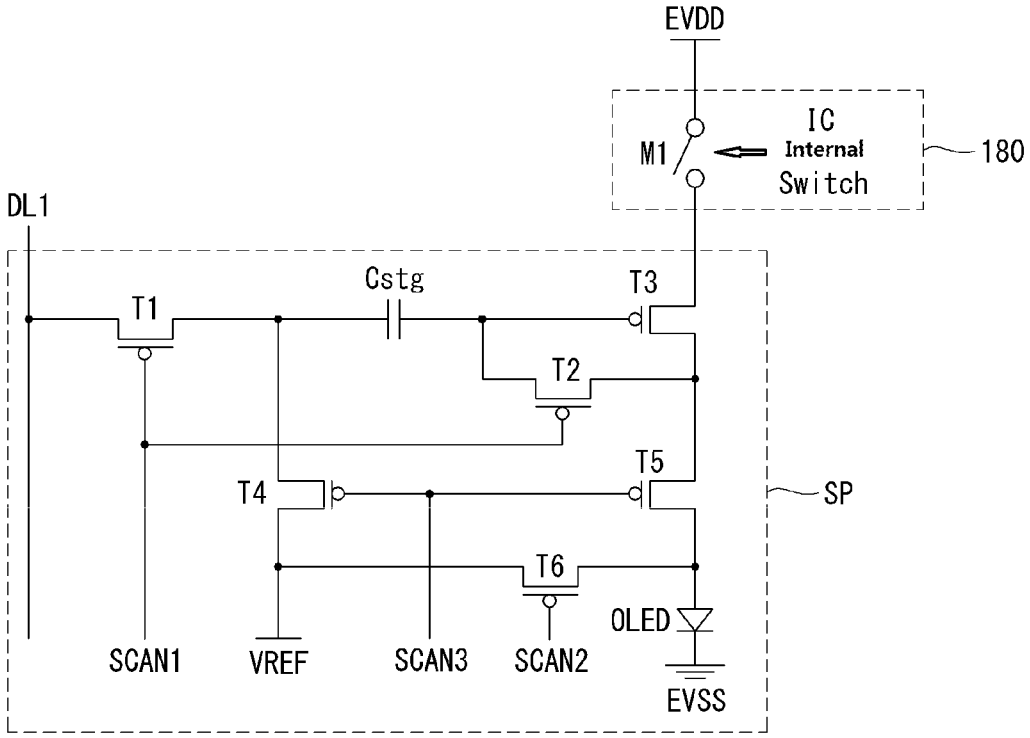
FIG. 9 is a view for illustrating an example circuit of a subpixel that prevents unintended leakage current, according to one embodiment.
Figure 10:
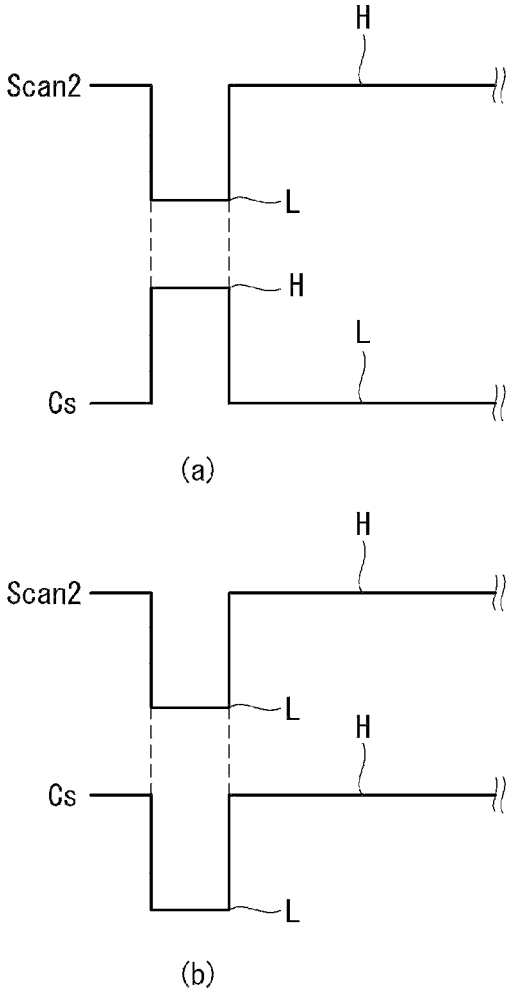
FIG. 10 is an exemplary view illustrating a power control signal for controlling a power controller of FIG. 9.

FIG. 8 is a view for illustrating unintended leakage current in the subpixel of FIG. 6; FIG. 9 is a view for illustrating an example circuit of a subpixel that prevents unintended leakage current, according to one embodiment; and FIG. 10 is an exemplary view illustrating a power control signal for controlling a power controller of FIG. 9.

As shown in FIGS. 7 and 8, during the first section (A), the first and third scan signals Scan1 and Scan3 are set at a logic high H, and the second scan signal Scan2 is set at a logic low L. The sixth transistor T6 is turned on in response to the second scan signal Scan2 of a logic low L. When the sixth transistor T6 is turned on, the reference voltage Vref is supplied to the reference voltage line VREF.

The reference voltage Vref is supplied to the anode electrode of the organic light emitting diode OLED. The reference voltage Vref supplied to the anode electrode of the organic light emitting diode OLED is discharged through the second voltage line EVSS. Here, the compensation circuit part senses the impedance value of the organic light emitting diode OLED through the turned-on sixth transistor T6.

Ideally, the compensation circuit part needs to be able to precisely sense the impedance value of the organic light emitting diode OLED through the sixth transistor T6 turned on during the first section (A). Only then, accurate compensation data can be prepared based on the impedance value of the organic light emitting diode OLED.

Therefore, in order to improve the sensing accuracy, the discharging path ② needs to be formed in a direction of the anode electrode and the cathode electrode of the organic light emitting diode OLED and the second voltage line EVSS. However, in the example circuit of FIG. 8, the leakage path ① may be formed through the third transistor T3 and the fifth transistor T5 during the first section (A).

For an accurate sensing of impedance value, when the impedance value of the organic light emitting diode OLED is sensed, the discharging path ② should be present without other unintended leakage current paths. However, in the example circuit of FIG. 8, the leakage path ① may be present between the first voltage line EVDD as a high voltage source and the organic light emitting diode OLED. As a result, the impedance value of the organic light emitting diode OLED may not be precisely sensed due to the leakage current through the third transistor T3 and the fifth transistor T5.

As shown in FIGS. 7, 9 and 10, during the first section (A), the first and third scan signals Scan1 and Scan3 are set at a logic high H, and the second scan signal Scan2 is set at a logic low L. The sixth transistor T6 is turned on in response to the scan signal Scan2 of a logic low L. When the sixth transistor T6 is turned on, the reference voltage Vref is supplied to the reference voltage line VREF.

The reference voltage Vref is supplied to the anode electrode of the organic light emitting diode OLED. The reference voltage Vref supplied to the anode electrode of the organic light emitting diode OLED is discharged through the second voltage line EVSS. Here, the compensation circuit part senses the impedance value of the organic light emitting diode OLED through the turned-on sixth transistor T6.

Ideally, the compensation circuit part needs to be able to precisely sense the impedance value of the organic light emitting diode OLED through the sixth transistor T6 turned on during the first section (A) to generate accurate compensation data based on the impedance value of the organic light emitting diode OLED.

However, as can be seen from the example shown in FIG. 8, the leakage path ① may be formed through the third transistor T3 and the fifth transistor T5 during the first section (A).

In one example embodiment as shown in FIG. 9, when the impedance value of the organic light emitting diode OLED is sensed, the leakage path ① may be removed by using the power control part 180 such that only the discharging path ② is present. Specifically, the power control part 180 is turned off when the impedance value of the organic light emitting diode OLED is turned off.

During the first section in which the impedance value of the organic light emitting diode OLED is sensed, the power control part 180 blocks the current flowing through the first voltage line EVDD, thereby physically removing the leakage path (①). To achieve this, the power control part 180 may be implemented as an integrated circuit (IC) including MOS switches.

As described with reference to FIG. 4, the power control part 180 serves to block the first voltage to be supplied to the subpixels formed on the display panel. In other embodiments, the power control part 180 may be formed at various positions. In addition, the power control signal may also vary depending on the type of a switch M1 included in the power control part 180.

As shown in (a) of FIG. 10, in order to sense the impedance value of the organic light emitting diode OLED, the power control signal Cs may be set at a logic high H when the second scan signal Scan2 is set at a logic low L. In this case, the power control part 180 controls the first voltage line EVDD in response to the power control signal Cs of a logic high H, thereby blocking the first voltage to be supplied to the subpixels.

As shown in (b) of FIG. 10, in order to sense the impedance value of the organic light emitting diode OLED, the power control signal Cs may be also set at a logic low L when the second scan signal Scan2 is set at a logic low L. In this case, the power control part 180 controls the first voltage line EVDD in response to the power control signal Cs of a logic low L, thereby blocking the first voltage to be supplied to the subpixels.

As shown in the example, when the impedance value of the organic light emitting diode OLED is sensed, the leakage path ① is removed by using the power control part 180 such that only the discharging path ② is present, thereby improving the degree of precision in sensing. In addition, accurate compensation data can be prepared based on the impedance value of the organic light emitting diode OLED.

As set forth above, the present invention has effects of improving the degree of precision in sensing of the subpixels and preparing accurate and uniform compensation data. Further, the present invention has an effect of preparing compensation data corresponding to characteristics (threshold voltage, current mobility, etc.) of devices included in the subpixels. Further, the present invention has effects of solving the reduction in lifetime and brightness of the devices and improving the display quality.

What is claimed is:

1. An organic light emitting display device, comprising:

a display panel having subpixels including organic light emitting diodes, each subpixel including a respective organic light emitting diode;

a data driving part for supplying a data signal to the display panel;

a compensation circuit part for sensing impedance values of the organic light emitting diodes of the subpixels;

a power generation part for generating and outputting power to be supplied to the display panel and the data driving part;

a voltage line wired between an output terminal of the power generation part and the display panel, the voltage line to transmit a voltage output from the power generation part to the display panel; and a power control part for controlling the voltage line, the power control part to block the voltage line to prevent the voltage from being supplied to the display panel, when an impedance value of an organic light emitting diode included in a subpixel is sensed.

2. The organic light emitting display of claim 1, wherein the power control part turns off a switch to disconnect the voltage line wired between the output terminal of the power generation part and the display panel, when the impedance value of the organic light emitting diode included in the subpixel is sensed.

3. The organic light emitting display of claim 1, wherein the power control part is turned on or turned off in response to a power control signal supplied from a timing control part for controlling the data driving part.

4. An organic light emitting display device, comprising:

a display panel having subpixels including organic light emitting diodes, each subpixel including a respective organic light emitting diode;

a data driving part for supplying a data signal to the display panel;

a compensation circuit part for sensing threshold voltages of the organic light emitting diodes of the subpixels;

a power generation part for generating and outputting power to be supplied to the display panel and the data driving part;

a voltage line wired between an output terminal of the power generation part and the display panel, the voltage line to transmit a voltage output from the power generation part to the display panel; and a power control part for controlling the voltage line, the power control part to block the voltage line to prevent the voltage from being supplied to the display panel, when a threshold voltage of an organic light emitting diode included in a subpixel is sensed.

5. The organic light emitting display of claim 4, wherein the power control part turns off a switch to disconnect the voltage line wired between the output terminal of the power generation part and the display panel, when the threshold voltage of the organic light emitting diode included in the subpixel is sensed.

6. The organic light emitting display of claim 4, wherein the power control part is turned on or turned off in response to a power control signal supplied from a timing control part for controlling the data driving part.

* * * * *